United States Patent [19]

Richter

[11] Patent Number: 4,978,041

[45] Date of Patent: Dec. 18, 1990

[54] TENNIS BALL RECEPTACLE AND DISPENSER

[76] Inventor: Bill Richter, 239 Sturtz St., Barrington, Ill.

[21] Appl. No.: 425,560

[22] Filed: Oct. 23, 1989

[51] Int. Cl.[5] ..... A63B 61/00

[52] U.S. Cl. ..... 222/608; 222/364; 222/517; 222/533; 221/263; 280/47.26; 273/29 A

[58] Field of Search ..... 222/181, 185, 344, 362, 222/517, 531, 533, 608, 363, 364, 424.5; 280/47.26, 47.18; 273/29 A, 26 R; 298/2; 221/193, 196, 263; 206/315.9

[56] References Cited

U.S. PATENT DOCUMENTS

| | | | |
|---|---|---|---|
| 2,950,925 | 8/1960 | Larson | 280/47.26 |
| 3,009,608 | 11/1961 | Lew | 222/364 |
| 4,383,695 | 5/1983 | Ray | 280/47.26 |
| 4,398,716 | 8/1983 | Argibay, Jr. et al. | 273/29 A |
| 4,667,847 | 5/1987 | Tucom | 221/196 |

*Primary Examiner*—Andres Kashnikow
*Assistant Examiner*—Karen B. Merritt

[57] ABSTRACT

A receptacle and dispenser for tennis balls and the like including, a portable barrel-like receptacle mounted upon a tubular wheeled frame. The lower edge of the receptacle at its foremost point is removed so as to present a dispensing mouth of a size greater that the diameter of a single tennis ball. A spring tension hinged tray extends beyond the circumference of the barrel to one side of the dispensing mouth so as to receive a plurality of tennis balls as they gravitate out of the receptacle, with the tray adapted to be manually pivoted about its hinged connection so as to expose the tennis balls therein for removal therefrom. A stop is placed in the path of pivotal travel of the tray to restrict its movement relative to the receptacle opening.

12 Claims, 4 Drawing Sheets

TENNIS BALL RECEPTACLE AND DISPENSER

BACKGROUND OF THE INVENTION

Prior art structures in the combined receptacle and dispensing field disclose elaborate methods of agitating the articles in the receptacle for selective dispensing therefrom. The most selective type dispenser utilizes a slide member which cooperates with a series of aligned apertures through which the article to be dispensed passes until captured by the slide. The slide may either permit the article to be dispensed, by falling free therefrom after actuation, or be designed to expose the article to be dispensed so that it may be manually removed.

Hinged door dispensers for ball holding receptacles normally merely open the receptacle thereby permiting the article to fall free therefrom. In other constructions the door provides a tail-like member which closes the entire dispensing opening as the remaining portion of the door allows dispensing of the article exteriorly of the receptacle.

Normally these prior types of receptacle dispensers required extensive and expensive design and structural elements, and which were complicated in construction and assembly thereby adding to the overall costs in material and labor.

BRIEF DESCRIPTION OF THE INVENTION

In the present tennis ball receptacle and dispenser, the receptacle is formed to provide an open dispensing mouth through which a number of tennis balls may freely pass on to a dispensing tray, with the tray being of a size to receive and retain a number of the tennis balls to be dispensed.

The dispensing tray is hingedly spring tensioned so as to be retained in a ball receiving position with respect to the dispensing mouth of the receptacle. The receiving tray is free to be manually pivoted about its hinge against the tension of the spring against a fixed stop which positions the tray in an inclined plane relative to the bottom surface of the receptacle, and from which the exposed number of balls can then be extracted. A tail-like member provided by the tray and positioned inwardly of its hinge will pivot in an elevated plane relative to the interior bottom wall surface of the receptacle so as to partially restrict the number of tennis balls remaining in the container to pass onto the tray during the dispensing of tennis balls therefrom.

An object of this invention is to provide a tennis ball recpetacle and dispenser which is highly portable so that it may be conveniently employed upon a tennis court during practice or instructional periods, making readily available an unlimited number of practice balls.

A further object of this invention is to provide a highly portable tennis ball receptacle and dispenser which is economical in manufacture, easily assembled, and highly efficient in use.

Other objects of the invention will be made apparent from the full description of its construction and operation as hereinafter set forth.

BRIEF DESCRIPTION OF THE DRAWINGS

The invention will be best understood by reference to the accompanying drawings which illustrate the preferred form of construction by which the objects of the invention are obtained and in which.

GENERAL DESCRIPTION OF THE INVENTION

Figure 1:
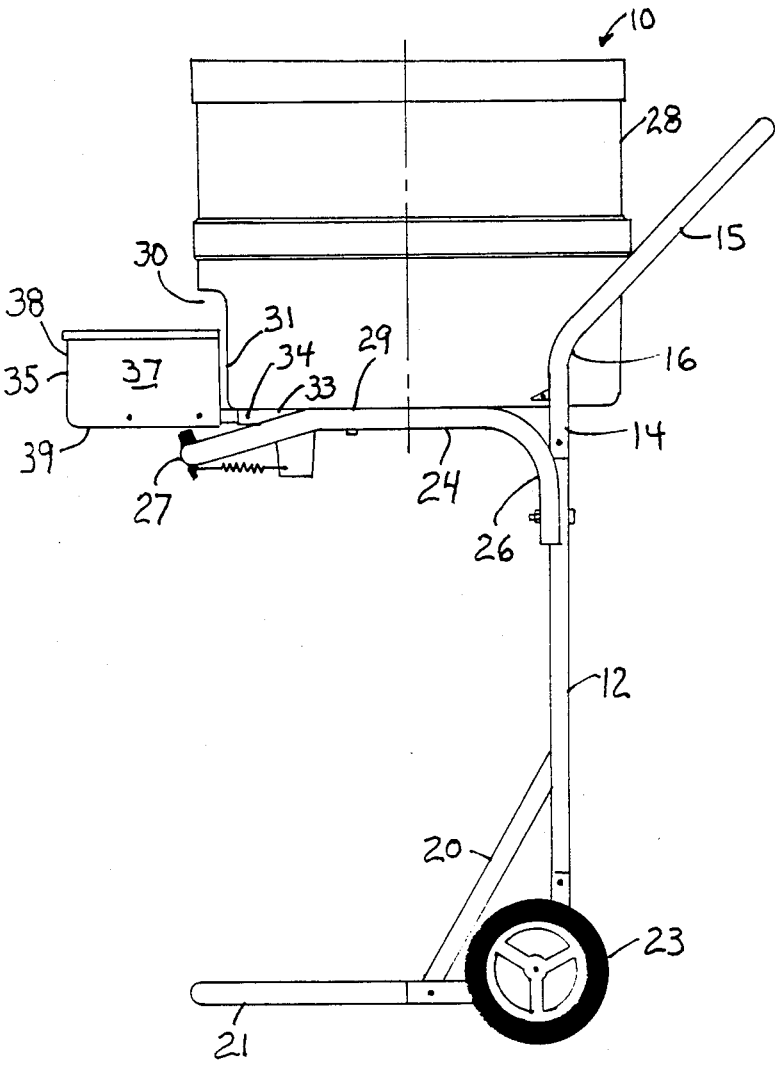
FIG. 1 is a side elevational view of the tennis ball receptacle and dispenser.
Figure 2:
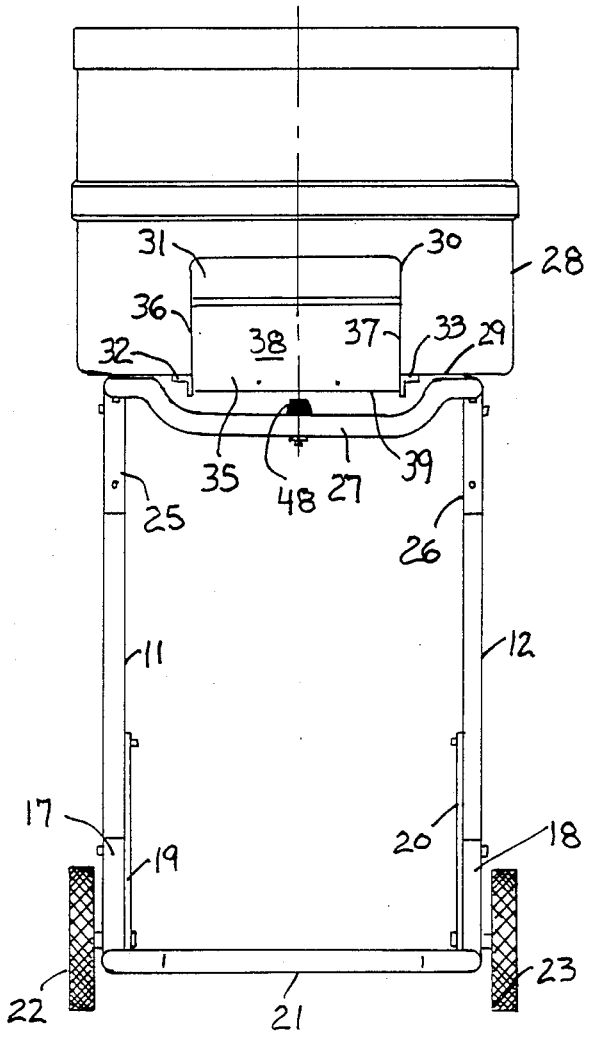
FIG. 2 is a front elevational view of the tennis ball receptacle and dispenser.

As illustrated in FIGS. 1 and 2 the tennis ball receptacle and dispenser is identified generally by reference numeral 10. It includes a tubular frame which consists of two verticle legs 11 and 12 adapted to be retained in verticle alignment with respect to each other. Attached to the upper ends of each of the verticle legs 11 and 12 are the free ends 14 of a substantially U-shaped handle 15. As illustrated the free ends 14 of the handle 15 are adapted to be short extensions of the legs 11 and 12 and then partially bent at a point 16, out of the longitudinal plane of the legs so as to position the handle 15 in an elevated inclined plane with respect to the legs 11 and 12.

Attached to the lowermost ends of the legs 11 and 12 are angularly bent corner forming elements 17 and 18. Gusset supports 19 and 20 are adapted to be attached to the legs 11 and 12 and the elements 17 and 18 to add rigidity thereto. A forwardly extending U-shaped ground engaging support 21 is connected to the free ends of the corner forming elements 17 and 18 and it cooperates with a pair of wheels 22 and 23 journalled upon the corner forming elements 17 and as to support the frame in a substantially upright receptacle supporting position.

A receptacle supporting member 24 is adapted to be attached to the uppermost ends of the legs 11 and 12. This support 24 is substantially U-shaped and has its free ends 25 and 26 curved out of its normal plane into a position where they will extend parallel to the legs 11 and 12. The bight portion 27 of the support 24 is likewise bent out the normal plane of the support into a depending position relative thereto, so as to make way for a dispensing tray.

A circular, open top, barrel-like receptacle 28 is adapted to be positioned upon the support 24 and between the bent portion 16 of the handle 15 as clearly shown in FIG. 1. The receptacle 28 may be fixed to the support and handle portions in any suitable manner.

Adjacent to the bottom 29 of the receptacle 28 a segment of its periphery is removed as at 30 so as to form an open dispensing mouth 31. It should also be noted that the dispensing mouth 31 extends partially into the bottom 29 of the receptacle 28 as clearly illustrated in FIGS. 3 and 4.

Fixedly attached to the underside of the receptacle 28 to either side of the dispensing mouth cut in the bottom wall 29 thereof are a pair of confronting angled tabs 32 and 33 (see FIG. 2). By suitable pivot pins 34 a dispensing tray 35 is hingedly connected to the receptacle 28 adjacent to the dispensing mouth 31.

The dispensing tray 35 consists of side walls 36 and 37 and an end wall 38. A bottom wall 39 extends between these walls and is of a length to project beyond the free edges of the side walls 36 and 37 and into the dispensing mouth area formed in the bottom wall 29 of the receptacle 28 as clearly shown in FIG. 3. To position the bottom wall 39 of the dispensing tray 35 in the plane of the bottom wall 29 of the receptacle 28 a stop member 40 is fixedly attached to the external wall surface of the bottom wall 29 at the innermost point of its dispensing mouth 31. Thus as illustrated the inner tail portion 41 of the bottom wall 39 of the tray 35 will, in its normal position, sit upon the stop 40.

Figure 3:
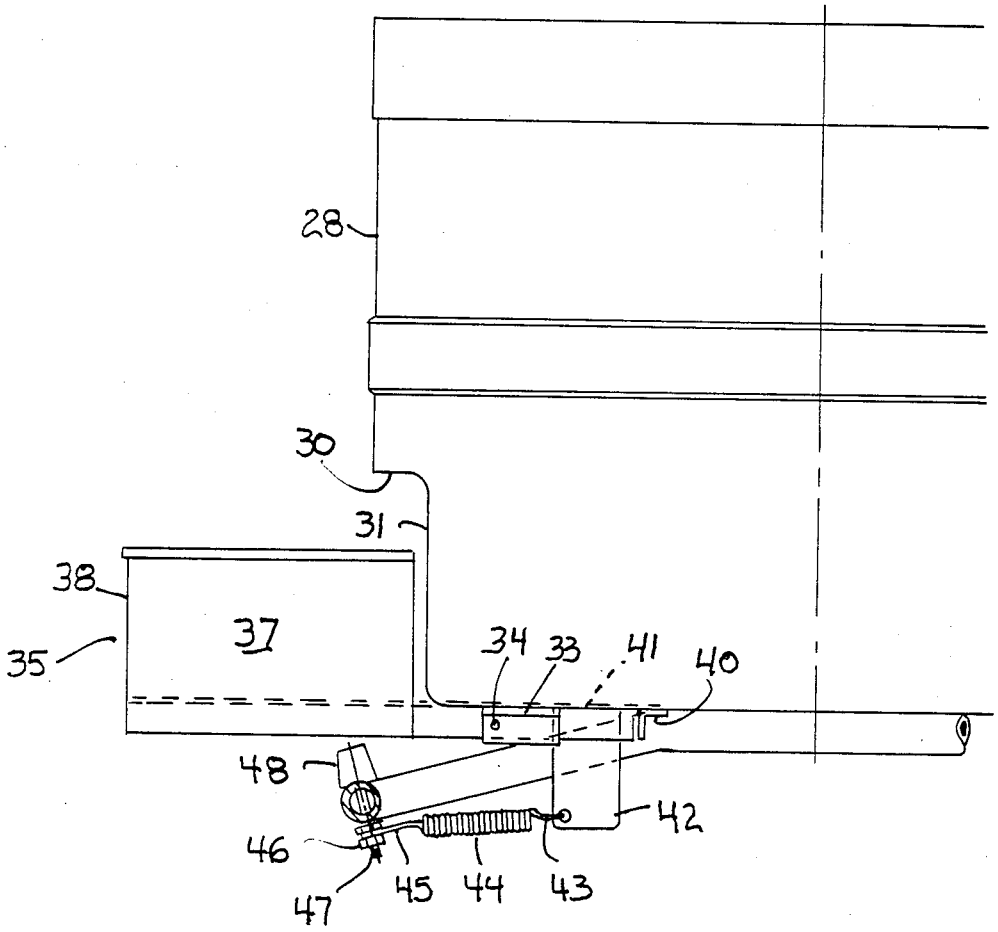
FIG. 3 is an enlarged fragmentary view of the dispenser in its closed position and, FIG. 4 is an enlarged fragmentary view of the dispenser in its dispensing position.
Figure 4:
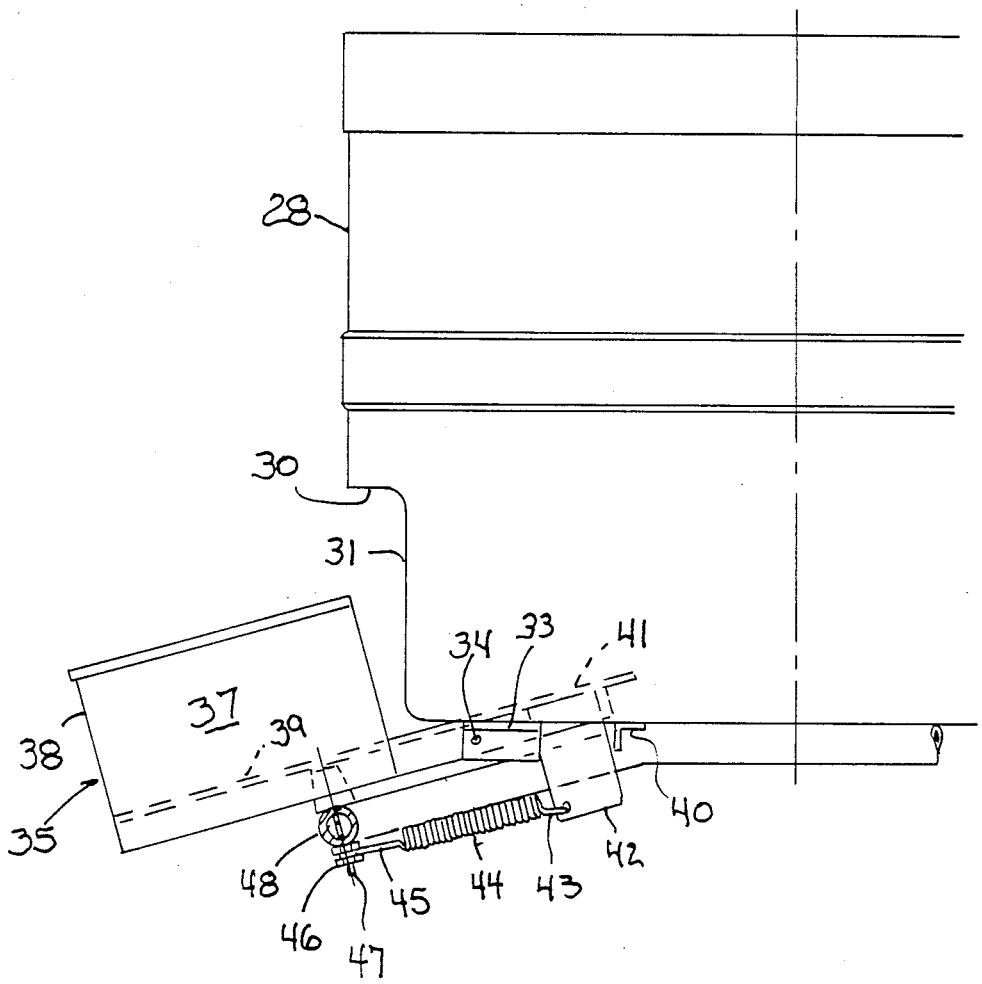

Depending from the bottom wall 39 of the tray 35 is a connecting block 42. As shown in FIGS. 3 and 4, one end 43 of an expansion spring 44 is attached adjacent to a lower forward corner of the connecting block 42. The opposite end 45 of the spring 44 is captured between two nuts 46 threaded upon the shaft 47 of the rubber bumper 48. As seen in FIG. 2 the rubber bumper 48 is attached to the bight portion 27 of the supporting member 24 at a mid-point thereon so as to be positioned beneath the tray 35. By this arrangement the spring 44 will normally yieldably position the tray 3 in a normal relative position to the dispensing mouth 31 with the tail portion 41 of its bottom wall 39 in alignment with the bottom wall 29 of the receptacle 28.

By reason of the angular relation between the bottom of the wheels 22 and 23 and the ground engaging support 21 the unit 10 will, when at rest, be inclined out of a verticle plane so that the tennis balls within the receptacle 28 will gravitate out of the dispensing mouth 31 and onto the tray 35. When it is desired to remove any number of the tennis balls from the tray 35 it will be manually depressed so as to pivot about its hinged connections, into the positon shown in FIG. 4. When the depressing force is removed the spring 44 will return to its normal position causing the tray to relocate to its normal position relative to the dispensing mouth 31. The tail portion 41 of the bottom wall 39 of the tray will prevent tennis balls within the receptacle 28 from falling through the opening formed in the bottom wall 29 thereof when the tray 35 has been pivoted into a ball dispensing position. The bumper 48 will restrict the pivotal movement of the tray 35 relative to the dispensing mouth 31 so as to correctly position it in a dispensing position relative to the receptacle 28.

While I have illustrated and describe the preferred form of construction for carrying my invention into effect, this is capable of variation and modification without departing from the spirit of the invention. I therefore, do not wish to be limited to the precise details of construction as set forth, but desire to avail myself of such variations and modifications as come within the scope of the appended claims.

Having thus described my invention what I claim as new and desire to protect by letters patent is:

1. A ball receptacle and dispenser comprising:

(a) a wheeled frame, (b) a barrel-like receptacle mounted on said frame, (c) an open dispensing mouth formed in said receptacle adjacent a portion of the bottom edge thereof, (d) a dispensing tray in open communication with said dispensing mouth and of a size to extend beyond the periphery of the receptacle and inwardly of the bottom edge thereof, (e) means for hingedly connecting said tray to said receptacle for pivotal movement into an inclined plane relative thereto so as to permit a number of balls within said receptacle to gravitate through said dispensing mouth and into an exposed position in said tray, and (f) means for yieldably resisting pivotal movement of said tray relative to said dispensing mouth of said receptacle.

2. A ball receptacle and dispenser as defined by claim 1 and including means for limiting the degree of pivotal movement of said dispensing tray relative to said receptacle.

3. A ball receptacle and dispenser as defined by claim 1 wherein said means for yieldably resisting pivotal movement of said dispensing tray relative to said dispensing mouth of said receptacle comprises a spring extending between a fixed positon on said frame and a position of said dispensing tray.

4. A ball receptacle and dispenser as defined by claim 3 including means for limiting the degree of pivotaal movement of said dispensing tray relative to said receptacle.

5. A ball receptacle and dispenser as defined by claim 2 wherein said means for limiting the degree of pivotal movement of said try comprises a fixed stop provided by said frame and being disposed in the path of pivotal movement of said dispensing tray.

6. A ball receptacle and dispenser as defined by claim 4 wherein said means for limiting the degree of pivotal movement of said dispensing tray comprises a fixed stop provided by said frame positioned in the path of the pivotal movement of said dispensing tray.

7. A ball receptacle and dispenser comprising:

(a) a wheeled lightweight tubular frame, (b) an open top barrel-like receptacle mounted in an upright position on said frame, (c) an open dispensing mouth formed in the side wall and bottom of said receptacle adjacent a portion of the bottom edge thereof, (d) an open top dispensing tray mounted on said receptacle in proximity to said dispensing mouth and providing a bottom wall of a length to extend inwardly of said dispensing mouth so as to lie in the normal plane of the bottom wall of said receptacle, (e) means for hingedly connecting the bottom wall of said dispensing tray to said receptacle inwardly of said dispensing mouth for pivotal movement of said dispensing tray into an inclined plane relative to said receptacle so as to permit a number of balls within said receptacle to gravitate through said dispensing mouth and into an exposed position in said tray, and (f) means for yieldably resisting pivotal movement of said tray relative to said dispensing mouth of said receptacle.

8. A ball receptacle and dispenser as defined by claim 7 and including means for limiting the degree of pivotal movement of said dispensing tray relative to said receptacle.

9. A ball receptacle and dispenser as defined by claim 7 wherein said means for yieldably resisting pivotal movement of said dispensing tray relative to said dispensing mouth of said receptacle comprises a coil spring extending beneath said dispensing tray between a fixed point on said frame and a portion of said dispensing tray.

10. A ball receptacle and dispenser as defined by claim 9 including means for limiting the degree of pivotal movement of said dispensing tray relative to said receptacle.

11. A ball receptacle and dispenser as defined by claim 8 wherein said means for limiting the degree of pivotal movement of said dispensing tray comprises a fixed stop provided by said frame with said stop being disposed in the path of pivotal movement of said dispensing tray.

12. A ball receptacle and dispenser as defined by claim 10 wherein said means for limiting the degree of pivotal movement of said dispensing tray comprises a fixed stop provided by said frame with said stop being disposed in the path of pivotal movement of said dispensing tray.

* * * * *